US005859394A

United States Patent [19]

Seehaus et al.

[11] Patent Number: 5,859,394

[45] Date of Patent: Jan. 12, 1999

[54] MUFFLER WITH STAMPED INTERNAL PLATES DEFINING TUBES AND SEPARATING CHAMBERS

[75] Inventors: Christian Seehaus, Waldfeucht; Stephen E. Jochum, Aachen, both of Germany; Jon W. Harwood, Toledo, Ohio

[73] Assignee: AP Parts Manufacturing Company, Toledo, Ohio

[21] Appl. No.: 873,861

[22] Filed: Jun. 12, 1997

Related U.S. Application Data

[60] Provisional application No. 60/036,878, Feb. 4, 1997.

[51] Int. Cl. [6] ..... F01N 7/18

[52] U.S. Cl. ..... 181/282; 181/272; 181/276

[58] Field of Search ..... 181/282, 265, 181/266, 269, 272, 276

[56] References Cited

U.S. PATENT DOCUMENTS 4,132,286 1/1979 Hasui et al. ..... 181/269
4,765,437 8/1988 Harwood et al. ..... 181/282
5,004,069 4/1991 Van Blaircum et al. .
5,173,577 12/1992 Clegg et al. .
5,252,788 10/1993 Emrick et al. .
5,563,383 10/1996 Harwood .
5,563,385 10/1996 Harwood .
5,597,986 1/1997 Harwood et al. .

*Primary Examiner*—Khanh Dang
*Attorney, Agent, or Firm*—Dickinson Wright PLLC

[57] ABSTRACT

An exhaust muffler includes upper and lower internal plates and upper and lower external shells. The internal plates are formed to define a chamber therebetween. The external shells are formed to define chambers on opposite respective sides of the interconnected internal plates. An upper tube plate is secured to the upper internal plate. The upper tube plate and the upper internal plate are formed to define an inlet tube therebetween. The inlet tube includes louvers to permit exhaust gas flow into the chamber between the upper internal plate and the upper external shell. Louvers in the upper internal plate permit exhaust gas to flow from the upper chamber into the internal chamber between the internal plates. Louvers in the lower internal plate permit exhaust gas to flow into the lower chamber. An outlet tube communicates with the gravitational low point in the lower external shell and permits flow of exhaust gas from the muffler while siphoning condensate in the lower chamber.

10 Claims, 3 Drawing Sheets

MUFFLER WITH STAMPED INTERNAL PLATES DEFINING TUBES AND SEPARATING CHAMBERS

This application claims the benefit of Provisional Appl. No. 60/036,878 filed Feb. 4, 1997.

BACKGROUND OF THE INVENTION

1. Field of the Invention

The subject invention is directed to exhaust mufflers manufactured substantially from formed components, such as stamp formed sheets of metal.

2. Description of the Prior Art

The typical prior art exhaust muffler includes a plurality of separate parallel tubes that are supported by transversely extending baffles. The baffles typically are of oval or circular shape. The assembly of tubes and baffles is slid into a tubular shell having a shape conforming to the shape of the baffles. An outer wrapper may be wrapped around the shell for additional strength and for noise insulation. Opposed end caps are then mechanically connected to the ends of the shell and wrapper to enclose the muffler. The end caps include apertures to define an inlet and an outlet on the muffler. The most common prior art mufflers include a single inlet in one end cap of the muffler and a single outlet in the opposed end cap. However, other configurations of inlets and outlets are possible and are used periodically to accommodate the particular needs of an exhaust system.

Chambers are formed within the above described prior art muffler between adjacent baffles or between a baffle and an end cap. Selected tubes within the muffler may be perforated or louvered to permit a controlled expansion of exhaust gas into the surrounding chamber. Other tubes may have their end in a particular chamber so that all gas flowing through that tube will empty into the associated chamber. The particular dimensions of the tubes, chambers and apertures or louvers will be selected to efficiently attenuate the noise associated with the exhaust gas flowing from the engine.

The primary flow of exhaust gas in the above described prior art muffler is generally parallel to the axis of the tubular outer shell. However the flowing exhaust gas will periodically reverse directions in chambers formed adjacent the end caps. A secondary flow of exhaust gas may occur as the exhaust gas expands through the perforations or louvers in a tube and into surrounding chambers. Prior art mufflers with tubular outer shells generally have not included chamber walls that extend parallel to the axis of the outer shell.

The prior art mufflers described above generally perform very well. However, these mufflers include a large number of separate parts that must be assembled in a labor intensive manufacturing process. Additionally, these prior art mufflers are limited to substantially tubular shapes with few options for location and alignment of the inlet and outlet of the muffler.

The prior art also includes mufflers made substantially from a plurality of formed sheets of metal. The typical prior art stamp formed muffler includes a pair of internal plates that are formed with channels. The internal plates are secured in face-to-face relationship such that oppositely directed channels substantially register with one another and define tubes for accommodating the flowing exhaust gas. Portions of these stamp formed tubes may be perforated or louvered to permit an expansion of exhaust gas therefrom. The typical prior art stamp formed muffler further includes a pair of outer shells. Each outer shell is stamped to define a generally planar peripheral flange. At least one chamber extends from the plane of the peripheral flange. The peripheral flanges of these outer shells are secured to peripheral regions of the internal plates such that the chambers surround the array of tubes defined by the internal plates.

Typically each tube of the prior art stamp formed muffler will communicate simultaneously with the chambers on opposite sides of the respective internal plates. However, an exception is U.S. Pat. No. 4,765,437 which has first and second internal plates formed to define first and second substantially parallel tuning tubes. A first external shell defines a first low frequency resonating chamber surrounding the first internal plate, while a second external shell defines a second low frequency resonating chamber surrounding the second internal plate. Portions of the first plate that define a first tuning tube include an opening to permit the first tuning tube to communicate with the first low frequency resonating chamber. However, portions of the second tuning tube defined by the first internal plate have no opening. Hence the second tuning tube does not communicate with the first low frequency resonating chamber. Portions of the second internal plate defining the second tuning tube have an opening to permit the second tuning tube to communicate with the second low frequency resonating chamber. However, portions of the second internal plate defining the first tuning tube have no opening. Thus, if the internal plates are aligned horizontally, the first tuning tube may communicate with a top low frequency resonating chamber, while the second tuning tube may communicate with a bottom low frequency resonating chamber. Flow patterns of this type generally were not possible with the prior art conventional muffler with a wrapped outer shell. U.S. Pat. No. 5,004,069 shows a somewhat similar concept applied to expansion chambers.

Exhaust mufflers typically create a back pressure on the flowing exhaust gas. Back pressure retards engine performance, and hence an exhaust muffler should be designed to achieve its noise attenuating function without an unacceptably high back pressure. Stamp formed mufflers generally permit curved surfaces that are not possible with conventional mufflers employing standard tubes and wrapped outer shells. Curved surfaces reduce back pressure and improve engine performance. Back pressure may be further decreased by utilizing the maximum volume available for the flowing exhaust gas. In this regard, a large tube or large chamber is generally less restrictive than a smaller tube or smaller chamber for accommodating a flowing exhaust gas. A stamp formed muffler with effective use of curved surfaces to reduce back pressure is shown, for example, in U.S. Pat. No. 5,252,788. A stamp formed muffler that relies largely upon a plurality of in-line flow chambers in an effort to avoid high back pressure is shown in U.S. Pat. No. 5,173,577. In this latter muffler, each of the in-line flow chambers is disposed between the internal plates of the muffler. Certain of these in-line flow chambers or in-line flow tubes may be perforated to permit expansion of exhaust gas into surrounding chambers defined by the external shells. However, these chambers defined by the external shells are not part of the primary flow path of exhaust gas moving from the inlet to the outlet of the muffler.

The hot flowing exhaust gas typically includes caustic vapors. These vapors will condense when the engine is shut off and the muffler is permitted to cool. The caustic condensate will accumulate at the gravitational low point of the muffler, and may corrode the metal from which the muffler is formed. Various attempts have been made to prevent muffler corrosion. For example, some mufflers simply provide a drainage hole at the gravitational low point. However, the drainage hole can become clogged. Furthermore, some new car manufacturers will not permit drainage holes. Other mufflers provide a siphon tube extending from the gravitational low point to the outlet tube of the muffler. Pressure differentials between the gravitational low point in the chamber and the outlet tube will cause the flowing exhaust gas to effectively suck liquid from the gravitational low point. The incorporation of a separate siphon tube into a conventional muffler requires complex welding and additional costs. A stamp formed muffler with a separate siphon tube is shown in U.S. Pat. No. 5,563,385. A stamp formed muffler with a stamp formed siphon tube is shown in U.S. Pat. No. 5,563,383.

In view of the above, it is an object of the subject invention to provide a muffler manufactured substantially from stamped components with an enhanced ability to attenuate noise while maintaining a desirably low back pressure.

It is a further object of the subject invention to provide a stamp formed muffler with large flow paths and in-line flow chamber for the exhaust gas.

A further object of the subject invention is to provide a muffler having a plurality of in-line flow chambers separated from one another by internal plates of the muffler.

Still a further object of the subject invention is to provide a muffler that can effectively siphon exhaust gas from the gravitational low point of the muffler without providing separate siphon tubes.

SUMMARY OF THE INVENTION

The subject invention is directed to an exhaust muffler manufactured from a plurality of sheets of material. The respective sheets are formed to define a plurality of exhaust passages and chambers as described herein. The formation of the sheets preferably is carried out by stamping. However, other known metal formation techniques may be employed, such as forming techniques that rely upon hydraulic forces, magnetic forces and/or explosive forces.

The muffler comprises at least one internal plate formed to include a peripheral flange and a channel. Portions of the internal plate between the peripheral flange and the channel may include a plurality of louvers, perforations or other known opening means for accommodating a flow of exhaust gas. The internal plate may be a first internal plate, and the muffler may further include a second internal plate. The second internal plate may have a peripheral flange substantially registerable with the peripheral flange of the first internal plate and may further include an array of louvers, perforations or other opening regions disposed inwardly from the periphery. Portions of the internal plates spaced inwardly from the registered peripheral flanges may be formed to define an internal chamber therebetween.

The muffler further includes an inlet tube plate formed to define a channel flange dimensioned and configured for engagement with portions of the internal plate or the first internal plate on opposite respective sides of the channel formed therein. Thus, the channel in the internal plate and the channel in the inlet tube plate function as an inlet tube for channeling exhaust gas into the muffler. Portions of the inlet tube may be provided with a plurality of louvers, perforations or other known opening means for permitting expansion of exhaust gas. Preferably the louvers in the inlet tube are formed in either the internal plate or the tube plate, but not in both. Thus, exhaust gas flow will be permitted from only one side of the inlet tube. Preferably the louvers are formed through a side of the inlet tube facing the gravitational top of the muffler.

The muffler further includes first and second external shells. Each external shell is formed to define a chamber and a peripheral flange surrounding the chamber. Peripheral flanges of the first and second external shells are dimensioned and configured to register with one another and to register with the peripheral flange of the internal plate. The peripheral flanges of the external shells are secured to the peripheral flange of the internal plate so that chambers defined by the external shells surround the perforations or louvers in the internal plate. The peripheral flange of the second external shell may be secured to the peripheral flange of the second internal plate on embodiments of the muffler having both first and second internal plates.

The second external shell preferably defines the gravitational bottom external shell. Thus, any condensate accumulating in the muffler will accumulate on the inwardly facing surface of the second external shell.

The muffler further includes at least one outlet tube extending from the chamber defined by the second external shell to an outlet of the muffler. The outlet tube may be a conventional separate tube extending from the chamber defined by the second external shell to an external region. The conventional tube may be bent to lie in substantially abutting relationship with the inwardly facing surface of the second external shell. Thus, the outlet tube will effectively siphon any condensate lying on the inwardly facing surface of the second external shell and remove the condensate from the muffler. The outlet tube may also be defined by an outlet tube plate. The outlet tube plate may be structurally similar to the inlet tube plate. In particular, the outlet tube plate may be formed to include a channel and flanges. The tube plate flanges may be secured to either an internal plate or the second external shell, and may extend to the outlet from the muffler. If the tube plate is secured to an internal plate of the muffler, it is preferred that the tube plate be dimensioned to extend into abutting contact with the second external shell to enable the outlet tube formed by the tube plate to effectively siphon condensate accumulated on the inwardly facing surface of the second external shell.

Exhaust gas enters the muffler of the subject invention by flowing through the inlet tube formed by the inlet tube plate and the internal plate. The exhaust gas then will flow through the perforations in the inlet tube and into the chamber defined between the internal plate and the first external shell. Exhaust gas will exit the chamber defined by the first external shell by flowing through the perforations in the internal plate. Embodiments of the muffler having first and second internal plates will permit flow of exhaust gas into the internal chamber defined between first and second internal plates. In this embodiment, the second internal plate will also include louvers or perforations to permit exhaust gas to exit into the chamber defined by the second external shell. Exhaust gas will then flow through the outlet tube and from the muffler. The outlet tube is positioned to permit flowing exhaust gas to siphon condensate from the gravitational low points of the muffler.

DETAILED DESCRIPTION OF THE PREFERRED EMBODIMENT

Figure 1:
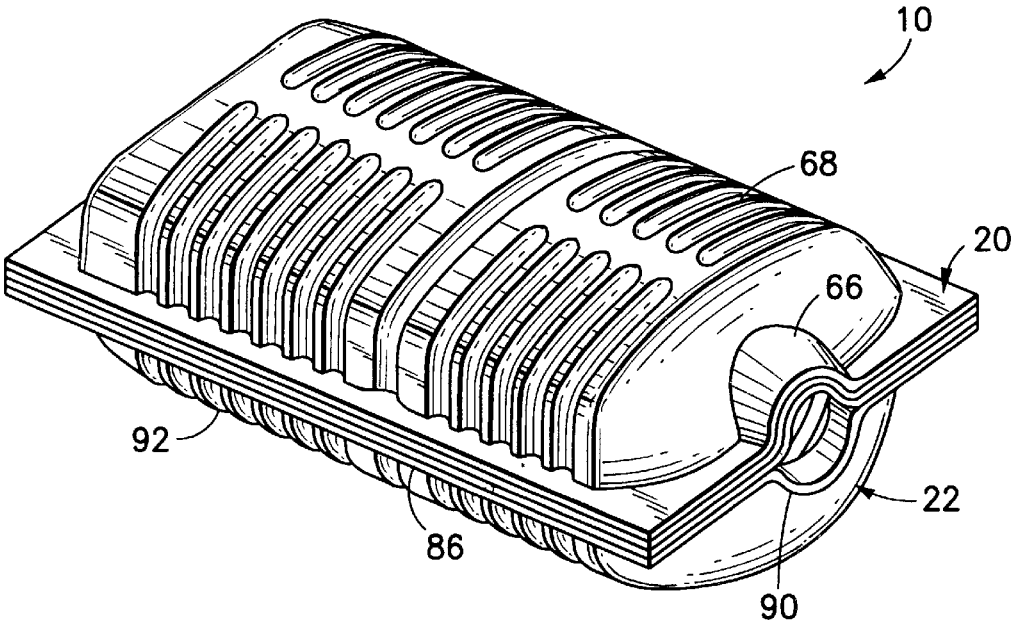
FIG. 1 is a perspective view of a muffler in accordance with the subject invention.

A muffler in accordance with the subject invention is identified generally by the numeral 10 in FIGS. 1–4. The muffler 10 includes upper and lower internal plates 12 and 14, upper and lower tube plates 16 and 18 and upper and lower external shells 20 and 22.

The upper internal plate 12 is generally rectangular as depicted herein, and includes an inlet end 24, an outlet end 26 and opposed longitudinal sides 28 and 30. However, many non-rectangular shapes may be provided in accordance with the available space on the vehicle. Additionally, the inlet and outlet of the muffler need not be at opposed ends or sides.

The upper internal plate 12 includes a top surface 32 and a bottom surface 34. A generally planar peripheral flange 36 extends substantially around the upper internal plate 12. Portions of the upper internal plate 12 within the area bounded by the peripheral flange 36 defines a chamber 37 that is formed such that the upper surface 32 is generally convex and the lower surface 34 is generally concave. The upper internal plate 12 is further characterized by an inlet channel 38 extending from the inlet end 24 to a location intermediate the opposed inlet and outlet ends 24 and 26. As shown herein, the inlet channel 38 extends downwardly, and therefore is a concave portion of the upper surface 30 of the upper internal plate 12. Additionally, as shown herein, the inlet channel 38 is substantially free of perforations or louvers. The upper internal plate 12 further includes a short outlet channel 40 extending to the outlet end 26 of the upper internal plate 12. The outlet channel 40 extends upwardly, and hence defines a convex portion of the upper internal plate 12. Portions of the upper internal plate 12 spaced from the inlet and outlet channels 38 and 40 and within the area defining the chamber 37 includes an array of louvers 42 passing entirely through the upper internal plate 12.

The upper tube plate 16 is significantly smaller than the upper internal plate 12. More particularly, the upper tube plate 16 includes a top surface 44, an opposed bottom surface 46. A peripheral flange 48 extends around the tube plate 16. The flange 48 is formed to fit in face-to-face relationship with a portion of the upper surface 32 of the upper internal plate 12 adjacent the inlet channel 38. Portions of the upper tube plate 16 inwardly from the peripheral flange 48 define an inlet channel 50. The inlet channel 50 extends upwardly, and hence defines a convex region on the top surface 44 of the upper tube plate 16. The inlet channel 50 is characterized by a plurality of louvers 52 extending through the upper tube plate 16. The bottom surface 46 of the upper tube plate 16 at the peripheral flange 48 thereof can be secured to portions of the upper surface 32 of the upper internal plate 12 adjacent to the inlet channel 38 therein. Thus, the inlet channel 50 of the upper tube plate 16 will register with the inlet channel 38 of the upper internal plate 12, and the registered inlet channels 50 and 38 will define an inlet tube. The perforations 52 in the upper tube plate 16 will permit exhaust gas entering the inlet tube to flow upwardly from the tube, but not downwardly.

The illustrated construction of the upper internal plate 12 and the upper tube plate 16 can be varied slightly without altering the performance. In particular, the inlet channel 38 of the upper internal plate may be formed to extend upwardly and may have perforations therein. The upper tube plate 16 may be formed such that the inlet channel thereof extends downwardly and is free of perforations. In this variation, the upper tube plate 16 would be secured to the lower surface 34 of the upper internal plate 12. Together, the inlet channels 38 and 50 would function as an inlet tube that would permit an upward flow of exhaust gas therefrom without a corresponding downward flow.

The upper external shell 20 includes an inlet end 54, an outlet end 56 and opposed longitudinal sides 58 and 60. A peripheral flange 62 extends around the periphery of the upper external shell 20 and is dimensioned and configured to register with the peripheral flange 36 of the upper internal plate 12. Portions of the peripheral flange 56 at the inlet end 54 include a semi-tubular portion 64 for engagement over the inlet channel 50 of the upper tube plate 16. Portions of the peripheral flange 62 at the outlet end 56 include a semi-tubular portion 66 for engagement over the outlet channel 40 in the upper internal plate 12. The upper external shell 20 further includes a chamber 68 extending convexly upwardly and dimensioned to surround the louvers 42 in the upper internal plate 12 and the louvers 52 in the upper tube plate 16. Thus, the chamber 68 defines an enclosed space for receiving exhaust gas flowing from the louvers 52 in the inlet tube.

The lower internal plate 14 is substantially rectangular and includes opposed top and bottom surfaces 70 and 72. The lower internal plate 14 includes a generally planar peripheral flange 74 extending entirely thereabout. The planar shape of the peripheral flange 74 is interrupted by a semi-tubular inlet channel 76 that is concavely formed into the upper surface 70 and that is dimensioned and disposed for closely engaging portions of the inlet channel 38 in the upper internal plate 12. The generally planar configuration of the peripheral flange 74 is also interrupted by a short semi-tubular outlet channel 78 that will nest with the outlet channel 40 of the upper internal plate 12. Portions of the lower internal plate 14 bounded by the peripheral flange 74 define a downwardly extending chamber 80. Thus, portions of the upper surface 70 defining the chamber 80 are concave. The chamber 80 is characterized by a plurality of louvers 82 extending entirely therethrough. Additionally, a central support 84 of the chamber 80 extends convexly upward to define a surface that can be welded into secure engagement with the inlet channel 38 for enhanced rigidity of the entire muffler 10.

The lower external shell 22 includes a generally planar peripheral flange 86 dimensioned and configured for registration with the peripheral flange 74 on the lower internal plate 14. The generally planar configuration of the peripheral flange 86 is interrupted by a downwardly extending short inlet channel 88 disposed and dimensioned for registration with inlet channel 76 of the lower internal plate 15. Additionally, a short semi-tubular outlet channel 90 is defined on the peripheral flange 86 for registration with the outlet channel 78 in the lower internal plate 14. Portions of the lower internal plate 22 inwardly from the peripheral flange 86 define a lower chamber 92 extending downwardly from the peripheral flange 86. The chamber 92 is dimensioned and configured to be in spaced relationship to the chamber 80 of the lower internal plate 14.

The lower tube plate 18 includes an upper surface 96 and a lower surface 98. A pair of peripheral flanges 100 and 102 are formed to conform to the shape of the lower external shell extending from an intermediate position in the chamber 92 thereof to the outlet channel 90. Portions of the outlet tube plate 18 between the peripheral flanges 100 and 102 define an outlet channel 104 extending convexly upwardly.

Figure 2:
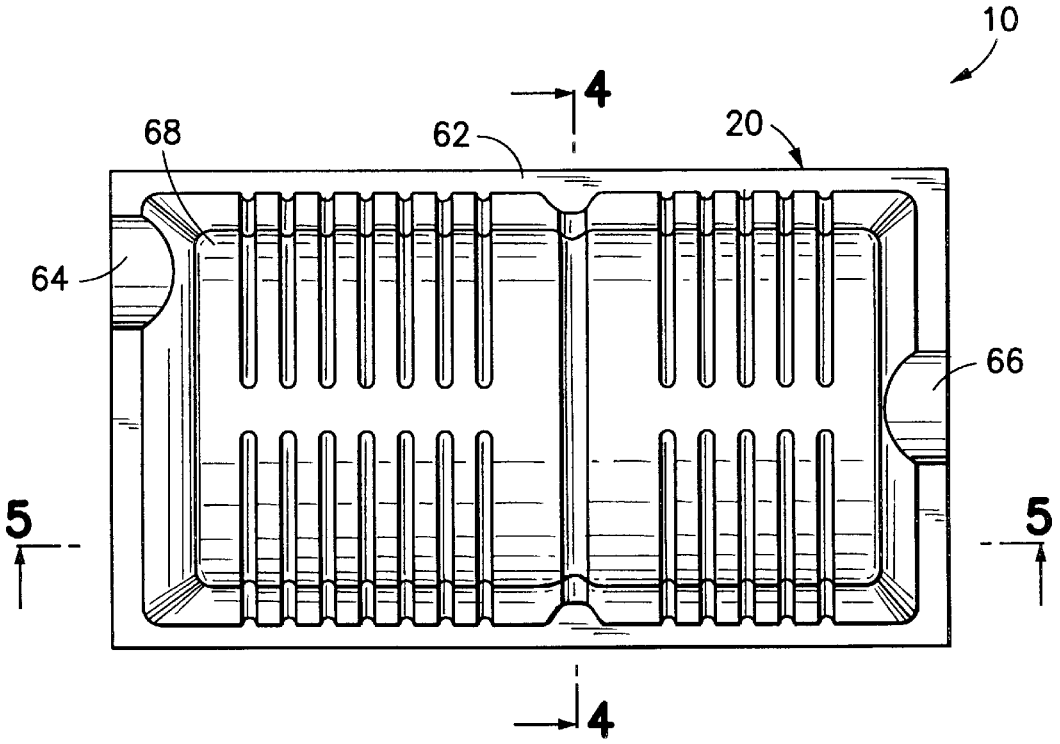
FIG. 2 is a top plan view of the assembled muffler of FIG. 1.
Figure 3:
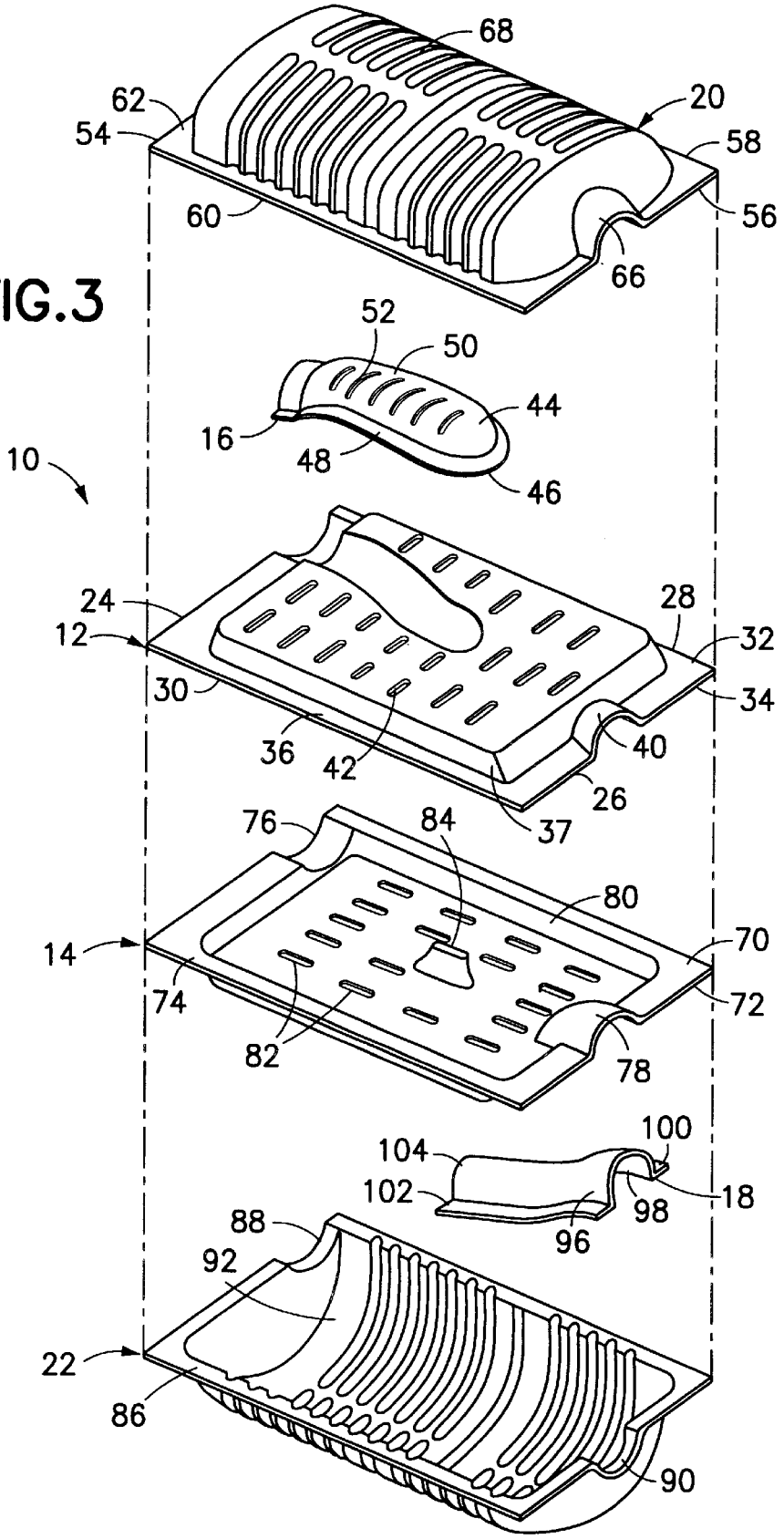
FIG. 3 is an exploded perspective view of the muffler of FIGS. 1 and 2.
Figure 4:
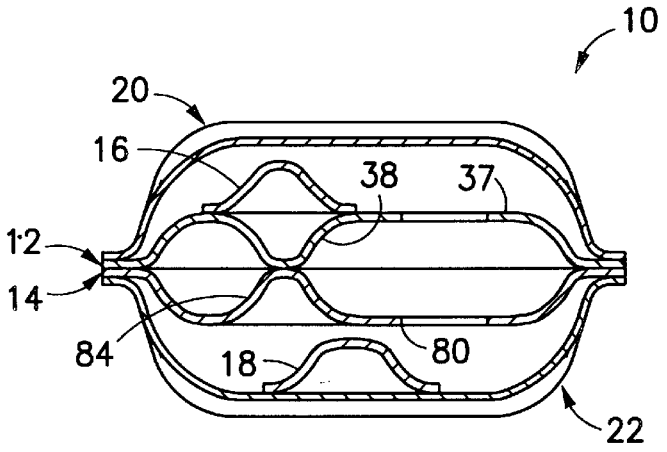
FIG. 4 is a cross-sectional view taken along line 4—4 in FIG. 2.
Figure 5:
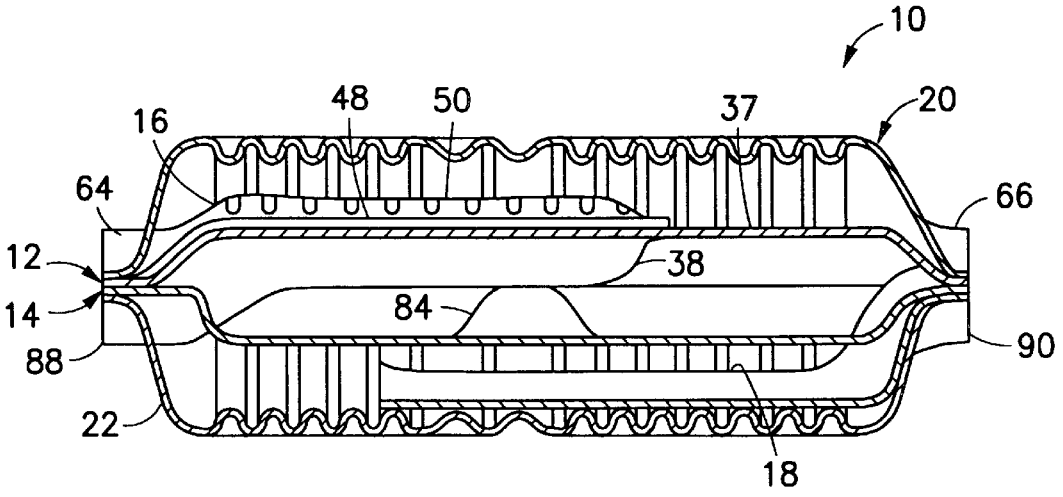
FIG. 5 is a cross-sectional view taken along line 5—5 in FIG. 4.

The muffler 10 is assembled as shown in FIGS. 2–4 by welding the lower surface 46 of the peripheral flange 48 on the upper tube plate 16 to regions of the upper surface 32 on the upper internal plate 12 surrounding the inlet channel 38 thereof. Thus, the inlet channel 38 and the inlet channel 50 will register with one another to define an inlet tube for the muffler. Perforations 52 in the inlet channel 50 will permit communication upwardly of exhaust gas entering the inlet tube. The upper surface 70 on the peripheral flange 74 of the lower internal plate is then secured to the lower surface 34 of the peripheral flange 36 of the upper internal plate 12. With this attachment, the formed chambers 37 and 80 bounded by the respective peripheral flanges 36 and 74 extend away from one another to define an internal chamber between the upper and lower internal plates 12 and 14. The chamber may be rigidified by welding the central support 84 to portions of the lower surface 34 of the upper internal plate 12 defining the inlet channel 38. With this constructions, the louvers 42 in the upper internal plate and the louvers 82 in the lower internal plate 14 provide for gas communication into and out of the internal chamber defined between the upper and lower internal plates 12 and 14.

Construction of the muffler 10 proceeds by securely welding the lower tube plate 18 to the upper surface of the lower external shell 22. More particularly, the peripheral flanges 100 and 102 are secured in face-to-face relationship with the upper surface of the lower external shell 22, such that the outlet channel 104 cooperates with opposed surface regions of the lower external shell 22, including the outlet channel 90 thereof to define an outlet from the muffler 10.

The assembly of the muffler 10 continues by securely welding the peripheral flange 62 of the upper external shell 20 to the peripheral flange 36 of the upper internal plate 12. Simultaneously, the peripheral flange 86 of the lower external shell 22 is securely welded to the peripheral flange 74 of the lower internal plate 14.

The muffler 10 functions substantially as follows. Exhaust gas flowing from the engine and through the exhaust pipe will enter the muffler 10 through the inlet tube formed by the registered inlet channels 38 and 50. This exhaust gas can flow only upwardly through the perforations 52 in the inlet channel 50 of the upper tube plate 16. Exhaust gas will flow from these louvers 52 and into the upper external chamber 68 defined by the upper external shell 20. Exhaust gas will continue through the muffler by flowing through the perforations 42 in the upper internal plate 12 and into the internal chamber between the upper and lower internal plates 12 and 14. Exhaust gas then will exit the internal chamber between the upper and lower internal plates 12 and 14 by flowing through the perforations 82 in the lower internal plate 14 and into the chamber 92 defined by the lower external shell 22. Exhaust gas will then enter the outlet tube defined by the lower tube plate 18 and will exit the muffler. The lower tube plate 18 is secured adjacent the gravitational low point defined by the chamber 92, and hence will effectively siphon condensate from the lower chamber 92.

The muffler 10 provides several desirable features. First, condensate is effectively removed without a drain hole or a separate construction for a siphon tube. Second, large volume chambers are defined in the muffler to achieve effective expansion of exhaust gas that will attenuate noise without creating undesirably high back pressure. Additionally, the muffler includes only an inlet tube and an outlet tube without the complex array of flow tubes therebetween. This simplifies the metal formation and reduces back pressure that could occur as exhaust gas enters and leaves successive tubes in a muffler.

While the invention has been described with respect to a preferred embodiment, it is apparent that changes can be made without departing from the scope of the invention as defined by the appended claims. For example, the lower tube plate defining the outlet tube may be affixed to the lower internal plate rather than to the lower external shell. With this construction, the lower tube plate need merely be dimensioned to fit adjacent the lower external shell to achieve effective siphoning of condensate. Second, a conventional tube could extend from an external location into the muffler to define the outlet. Third, only one internal plate may be provided depending upon the acoustical tuning needs of the muffler. In particular, the lower internal plate 14 depicted in FIG. 3 may simply be removed to provide a very effective muffler with the remaining components shown in FIG. 3. A single internal plate will achieve effective reduction in cost and weight for the muffler.

These and other changes will be apparent to a person skilled in the art upon reading the subject invention disclosure.

What is claimed is:

1. A muffler comprising:

top and bottom internal plates having peripheral regions securely connected to one another and having internal regions formed away from one another to define an internal chamber therebetween, said first and second plates having aperture means therethrough for permitting gas communication into and out of said internal chamber;

upper and lower external shells having peripheral regions secured respectively to the peripheral regions of said upper and lower internal plates, portions of said upper and lower external shells intermediate said peripheral regions thereof being formed to define upper and lower chambers enclosing the upper and lower internal plates and the aperture means therein;

an upper tube plate secured to said upper internal plate, said upper tube plate and said upper internal plate being formed relative to one another to define an inlet tube to the muffler, said inlet tube including aperture means for permitting gas communication into the upper chamber; and an outlet tube disposed in said lower chamber for permitting flow of exhaust gas from said lower chamber out of said muffler.

2. The muffler of claim 1, wherein the outlet tube is disposed substantially adjacent said lower external shell for siphoning condensate from said lower chamber out of said muffler.

3. The muffler of claim 2, wherein the outlet tube is formed from a lower tube plate secured to at least one of said lower external shell and said lower internal plate for defining an outlet tube.

4. The muffler of claim 1, wherein the upper tube plate is secured to a surface of said upper internal plate facing said upper external shell, said aperture means of said inlet tube being formed through said upper tube plate.

5. The muffler of claim 1, wherein portions of said inlet tube adjacent said internal chamber are substantially free of said aperture means.

6. A muffler comprising:

an internal plate having opposed top and bottom surfaces, said internal plate having peripheral regions extending thereabout, an inlet tube channel being formed in said internal plate, extending inwardly from said peripheral region of said internal plate and having a peripheral edge joining said internal plate, aperture means extending through said internal plate at locations between said inlet channel and said peripheral region;

upper and lower external shells secured to the peripheral region of said internal plate on the respective upper and lower surface thereof, portions of said upper and lower external shells intermediate said peripheral flanges thereof being formed to define upper and lower chambers surrounding said internal plate;

an inlet tube plate secured to said internal plate and having a peripheral portion being substantially registered with said peripheral edge of said inlet channel of said internal plate to define an inlet tube to the muffler, said inlet tube including aperture means for permitting gas communication into the upper chamber; and an outlet tube disposed in said lower chamber for permitting flow of exhaust gas from said lower chamber and out of said muffler.

7. The muffler of claim 6, wherein the outlet tube is disposed substantially adjacent said lower external shell for siphoning condensate from said lower chamber out of said muffler.

8. A muffler comprising:

an internal plate having opposed top and bottom surfaces, said internal plate having peripheral regions extending thereabout, an inlet tube channel being formed in said internal plate and extending inwardly from said peripheral region of said internal plate, aperture means extending through said internal plate at locations between said inlet channel and said peripheral region;

upper and lower external shells secured to the peripheral region of said internal plate on the respective upper and lower surface thereof, portions of said upper and lower external shells intermediate said peripheral flanges thereof being formed to define upper and lower chambers surrounding said internal plate;

an inlet tube plate secured to said internal plate and being substantially registered with said d inlet channel of said internal plate to define an inlet tube to the muffler, said inlet tube including aperture means for permitting gas communication into the upper chamber; and an outlet tube disposed in said lower chamber for permitting flow of exhaust gas from said lower chamber and out of said muffler, wherein the outlet tube is formed from a lower tube plate secured to at least one of said lower external shell and said internal plate for defining an outlet tube and is disposed substantially adjacent said lower external shell for siphoning condensate from said lower chamber out of said muffler.

9. The muffler of claim 6, wherein the inlet tube plate is secured to said upper surface of said internal plate facing said upper external shell, said aperture means of said inlet tube being formed through said inlet tube plate.

10. The muffler of claim 6, wherein portions of said inlet tube adjacent said lower chamber are substantially free of said aperture means.

* * * * *